US006385851B2

(12) United States Patent
Yeh

(10) Patent No.: US 6,385,851 B2
(45) Date of Patent: May 14, 2002

(54) HAIRDRESSING SCISSORS FOR CUTTING SMALL AMOUNT OF HAIR OR SPECIAL STYLE

(76) Inventor: Een-Ya Yeh, Suite 2, 15th floor, No. 18,Chuney-Hsueh Road, Tainan (TW)

( * ) Notice: Subject to any disclaimer, the term of this patent is extended or adjusted under 35 U.S.C. 154(b) by 0 days.

(21) Appl. No.: 09/853,809

(22) Filed: May 11, 2001

Related U.S. Application Data

(63) Continuation-in-part of application No. 09/510,568, filed on Feb. 22, 2000.

(51) Int. Cl.[7] ..... B26B 13/08
(52) U.S. Cl. ..... 30/195; 30/254
(58) Field of Search ..... 30/195, 355, 354, 30/229, 178

(56) References Cited

U.S. PATENT DOCUMENTS

| | | | | |
|---|---|---|---|---|
| 291,591 | A | 1/1884 | Gorton | |
| 799,617 | A | 9/1905 | Steffa | |
| 2,574,066 | A | * 11/1951 | See | 30/195 |
| 3,676,930 | A | 7/1972 | Robinson et al. | |
| 4,170,064 | A | 10/1979 | Senk | |
| 4,422,240 | A | 12/1983 | Wallace et al. | |
| 4,660,285 | A | 4/1987 | Pracht | |
| 5,107,591 | A | 4/1992 | Sato | |

FOREIGN PATENT DOCUMENTS

| | | |
|---|---|---|
| DE | 4000927 | 1/1991 |
| GB | 2153732 | 8/1985 |

* cited by examiner

*Primary Examiner*—Douglas D. Watts
(74) *Attorney, Agent, or Firm*—Alan Kamrath; Rider, Bennett, Egan & Arundel, LLP

(57) ABSTRACT

A pair of hairdressing scissors comprises first and second scissor elements pivotally connected together, each scissor element including a blade portion. The blade portion of the second scissor element has a cutting edge. The blade portion of the first scissor element includes a plurality of teeth that are spaced by an interval. Each tooth on the second scissor element includes a distal end having a first side that faces the cutting edge of the first scissor element and a second side that faces away from the cutting edge. The first side of the distal end of each tooth includes a distal first guide face and a second guide face extended from the distal first guide face. The distal first guide face has a slope smaller than that of the second guide face. The second guide face includes a cutting edge that cooperates with the cutting edge of the second scissor element for cutting hair. A distal beveled face and a third guide face are formed between the first side and the second side of the distal end. The distal beveled face guides hair to be cut. The guide face meets the first side at the cutting edge.

3 Claims, 10 Drawing Sheets

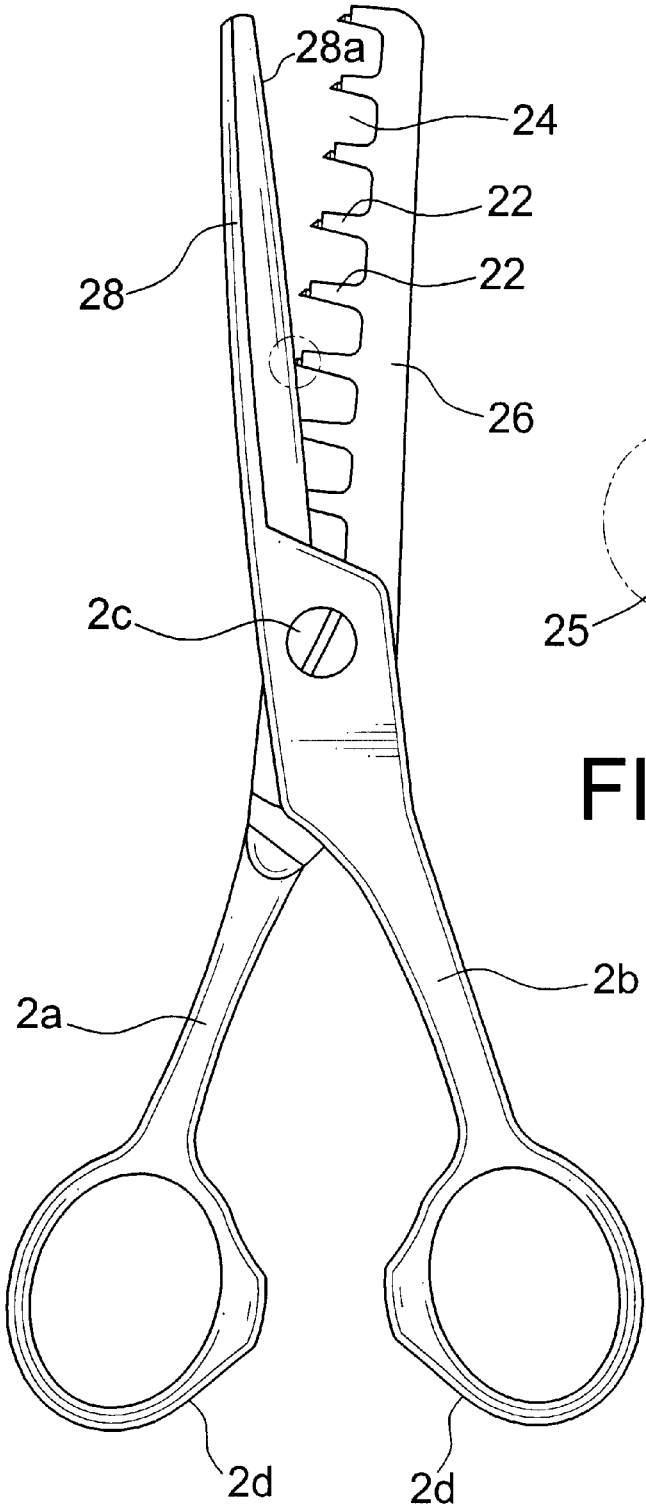
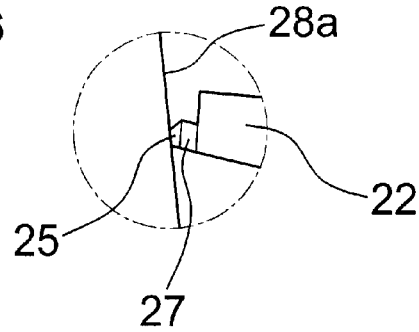
FIG.5A
FIG.5

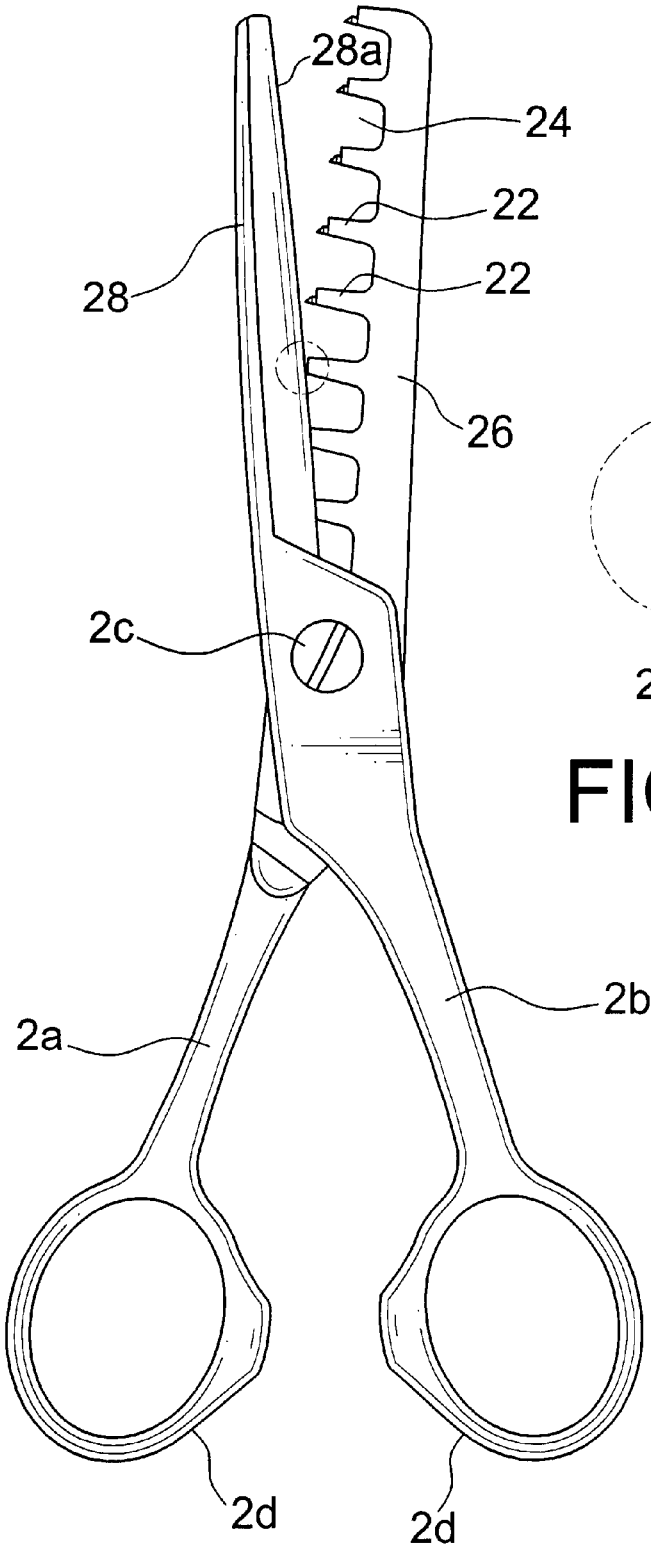
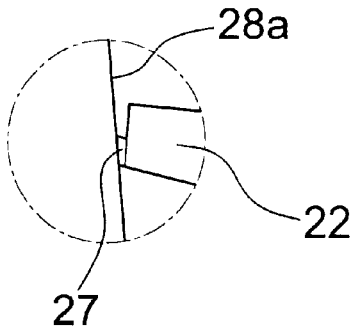
FIG.6A
FIG.6

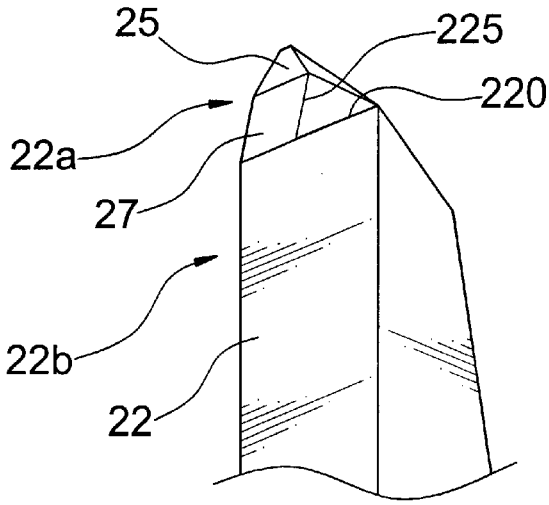
FIG.7
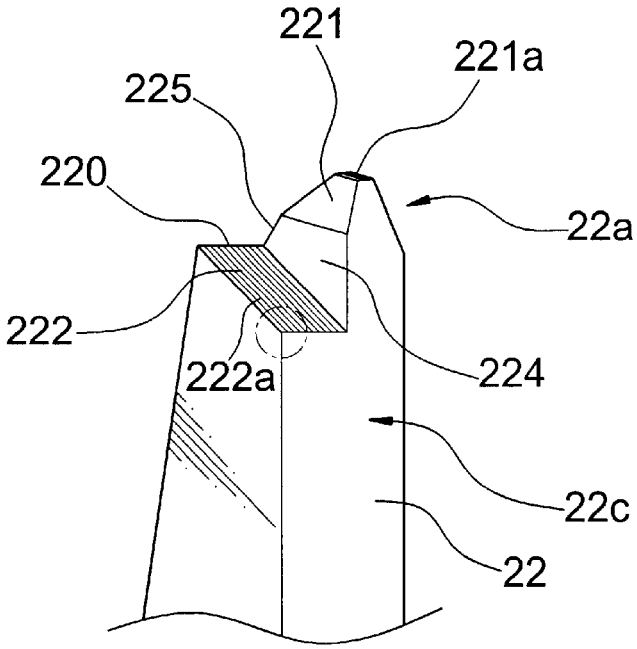
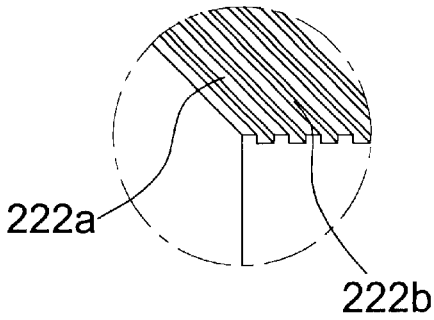
FIG.8A
FIG.8

HAIRDRESSING SCISSORS FOR CUTTING SMALL AMOUNT OF HAIR OR SPECIAL STYLE

CROSS REFERENCE TO RELATED APPLICATION

This is a continuation-in-part application of U.S. patent application Ser. No. 09/510,568 filed on Feb. 22, 2000.

BACKGROUND OF THE INVENTION

1. Field of the Invention

The present invention relates to a pair of hairdressing scissors for cutting small amount of hair or special shape.

2. Description of the Related Art

FIG. 9 of the drawings illustrates a pair of conventional hairdressing scissors which includes two scissor elements 3*a* and 3*b* pivotally connected together. The scissor element 3*a* includes a blade portion 36 with a plurality of wide teeth 32 that are spaced by larger interval 34. The hair amount cut by a pair of scissors is decided by the overall widths of all of the teeth 32, and the pair of scissors in FIG. 9 may cut about 50% of hair that is held between and thus cut by two blade portions 36 and 38. FIG. 10 of the drawings illustrates another pair of conventional hairdressing scissors which includes two scissor elements 4*a* and 4*b* pivotally connected together. The scissor element 4*a* includes a blade portion 46 with a plurality of narrow teeth 42 that are spaced by smaller interval 44. Such a pair of scissors may cut about 50% of hair that is held between and thus cut by two blade portions 46 and 48. FIG. 11 of the drawings illustrates a further pair of conventional hairdressing scissors which includes two scissor elements 5*a* and 5*b* pivotally connected together. The scissor element 5*a* includes a blade portion 56 with a first set of spaced wide teeth 52 and a plurality of second sets of narrow teeth 53, each second set of narrow teeth 53 being arranged between two adjacent wide teeth 52. Such a pair of scissors may cut about 80% of hair that is held between and thus cut by two blade portions 56 and 58. FIG. 12 of the drawings illustrates still another pair of conventional hairdressing scissors which includes two scissor elements 6*a* and 6*b* pivotally connected together. The scissor element 6*a* includes a blade portion 66 with a plurality of medium-sized teeth 62 that are spaced by medium-sized interval 64, each tooth 62 having a V-shape groove 65 in a distal end thereof. Such a pair of scissors may cut about 60% of hair that is held between and thus cut by two blade portions 66 and 68.

Each of the teeth 32, 42, 52, 53, 63 of the scissors shown in FIGS. 9 through 12 include a single guide face 37, 47, 57, 67 on a side thereof that faces the blade portion 38, 48, 58, 68 the scissor element, 3*b*, 4*b*, 5*b*, 6*b* for guiding the blade portion 38, 48, 58, 68 of the scissor element, 3*b*, 4*b*, 5*b*, 6*b* to be in intimate contact with the blade portion 36, 46, 56, 66, of the scissor element 3*a*, 4*a*, 5*a*, 6*a*, thereby achieving the required cutting function. Nevertheless, in some cases it is required to cut hair by small amount or cut into special style wherein some hair must be supported by its surrounding hair to exhibit a swollen or high-rise style. None of the above scissors can provide such a function.

The present invention is intended to provide a pair of scissors to meet this end.

SUMMARY OF THE INVENTION

It is the primary object of the present invention to provide a pair of hairdressing scissors for cutting small amount of hair or special style.

In accordance with the present invention, a pair of hairdressing scissors comprises first and second scissor elements pivotally connected together, each said scissor element including a blade portion. The blade portion of the second scissor element having a cutting edge. The blade portion of the first scissor element includes a plurality of teeth that are spaced by an interval.

Each tooth on the second scissor element includes a distal end having a first side that faces the cutting edge of the first scissor element and a second side that faces away from the cutting edge. The first side of the distal end of each tooth includes a distal first guide face and a second guide face extended from the distal first guide face. The distal first guide face has a slope smaller than that of the second guide face. The second guide face includes a cutting edge that cooperates with the cutting edge of the second scissor element for cutting hair.

A distal beveled face and a third guide face are formed between the first side and the second side of the distal end. The distal beveled face guides hair to be cut. The guide face meets the first side at the cutting edge. The third guide face is provided to guide hair that is cut down from the head.

In an embodiment of the invention, the distal end of each tooth includes a truncated tip for cutting hair. The third guide face includes a serrated surface with a plurality of channels for holding the hair to be cut during cutting.

Other objects, advantages, and novel features of the invention will become more apparent from the following detailed description when taken in conjunction with the accompanying drawings.

BRIEF DESCRIPTION OF THE DRAWINGS

FIG. 5 is an elevational view of a second embodiment of a pair of hairdressing scissors in accordance with the present invention.

FIG. 5A is an enlarged view of a circle in FIG. 5.

FIG. 6 is an elevational view similar to FIG. 5, illustrating operation of the pair of scissors.

FIG. 6A is an enlarged view of a circle in FIG. 6.

FIG. 7 is a perspective view of an end portion of a tooth of the pair of hairdressing scissors in FIG. 5.

FIG. 8 is a perspective view illustrating the other side of the tooth in FIG. 7.

FIG. 8A is an enlarged view of a circle in FIG. 8.

DETAILED DESCRIPTION OF THE PREFERRED EMBODIMENTS

Figure 1:
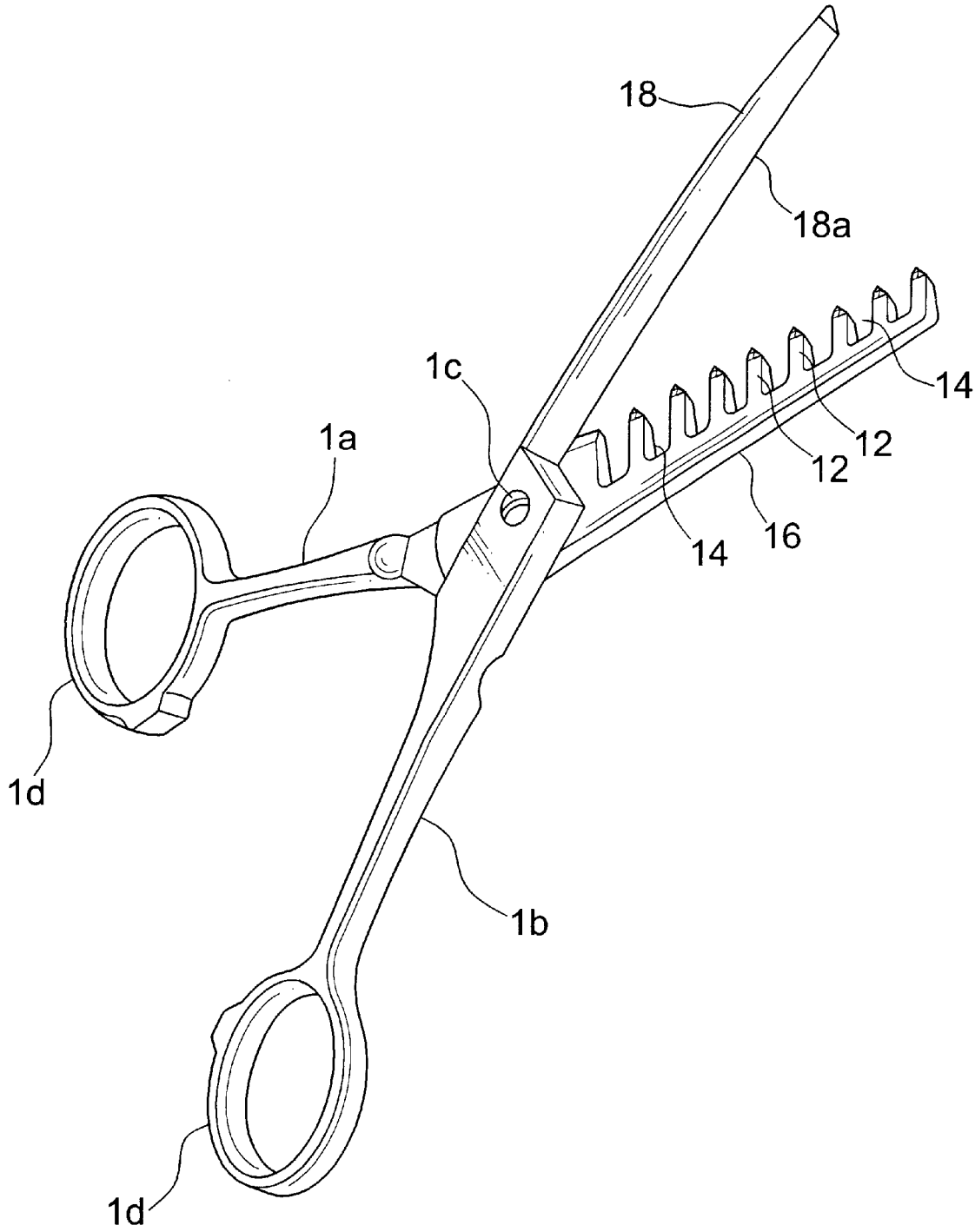
FIG. 1 is a perspective view of a first embodiment of a pair of hairdressing scissors in accordance with the present invention.
Figure 4:
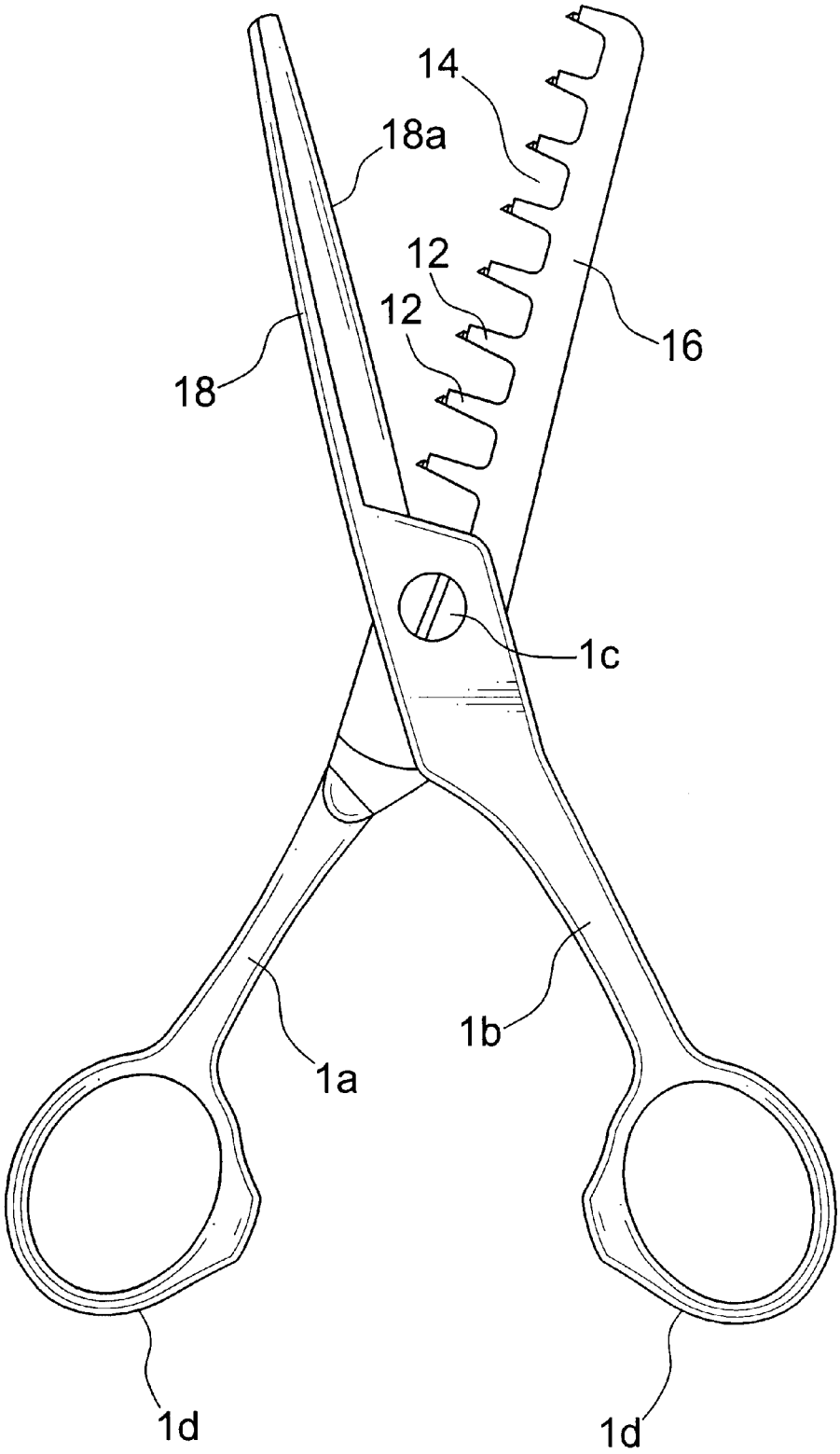
FIG. 4 is an elevational view of the pair of hairdressing scissors in accordance with the present invention.
Figure 9:
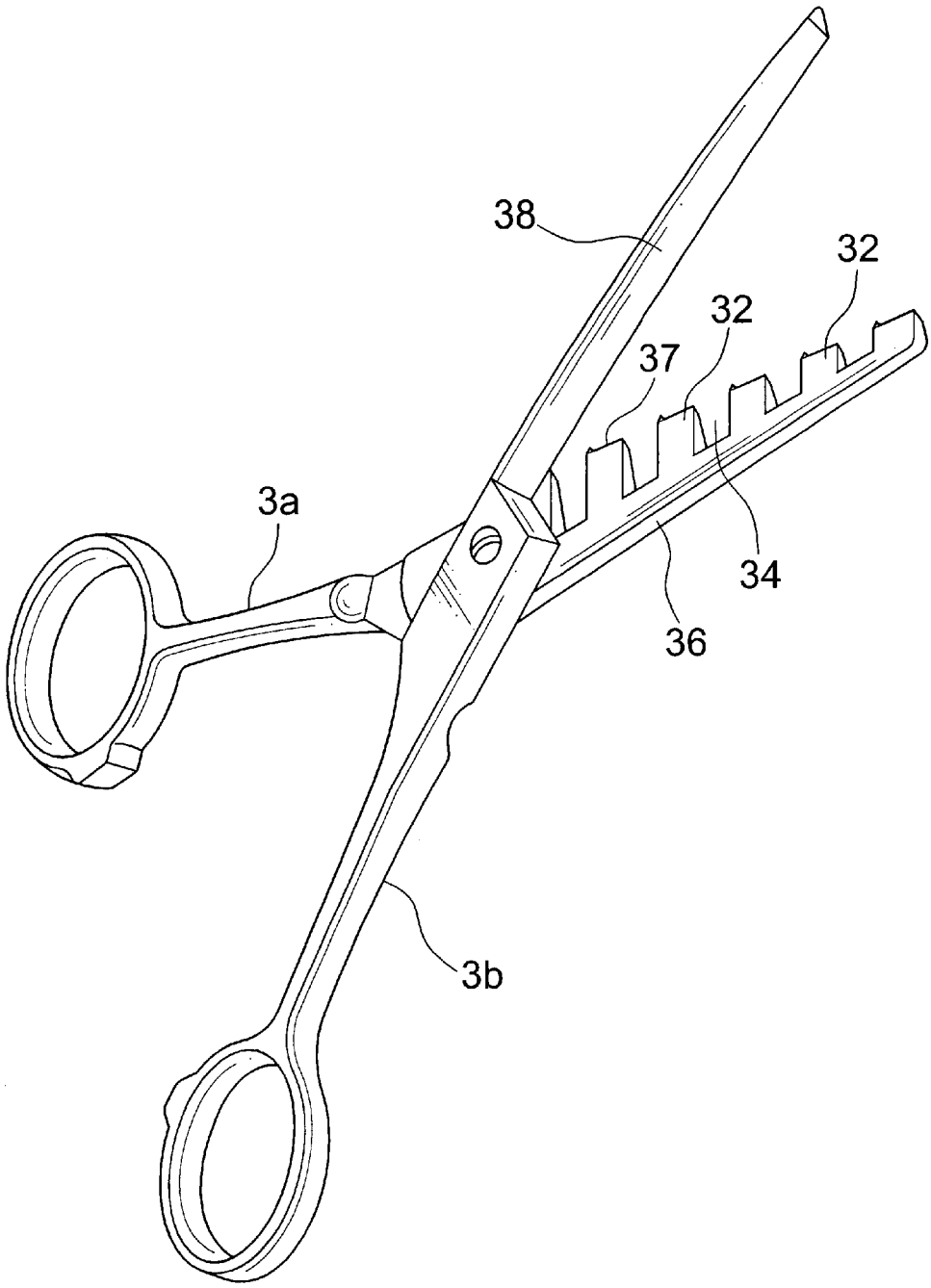
FIG.9 PRIOR ART
FIG. 9 is a perspective view of a pair of conventional hairdressing scissors.
Figure 10:
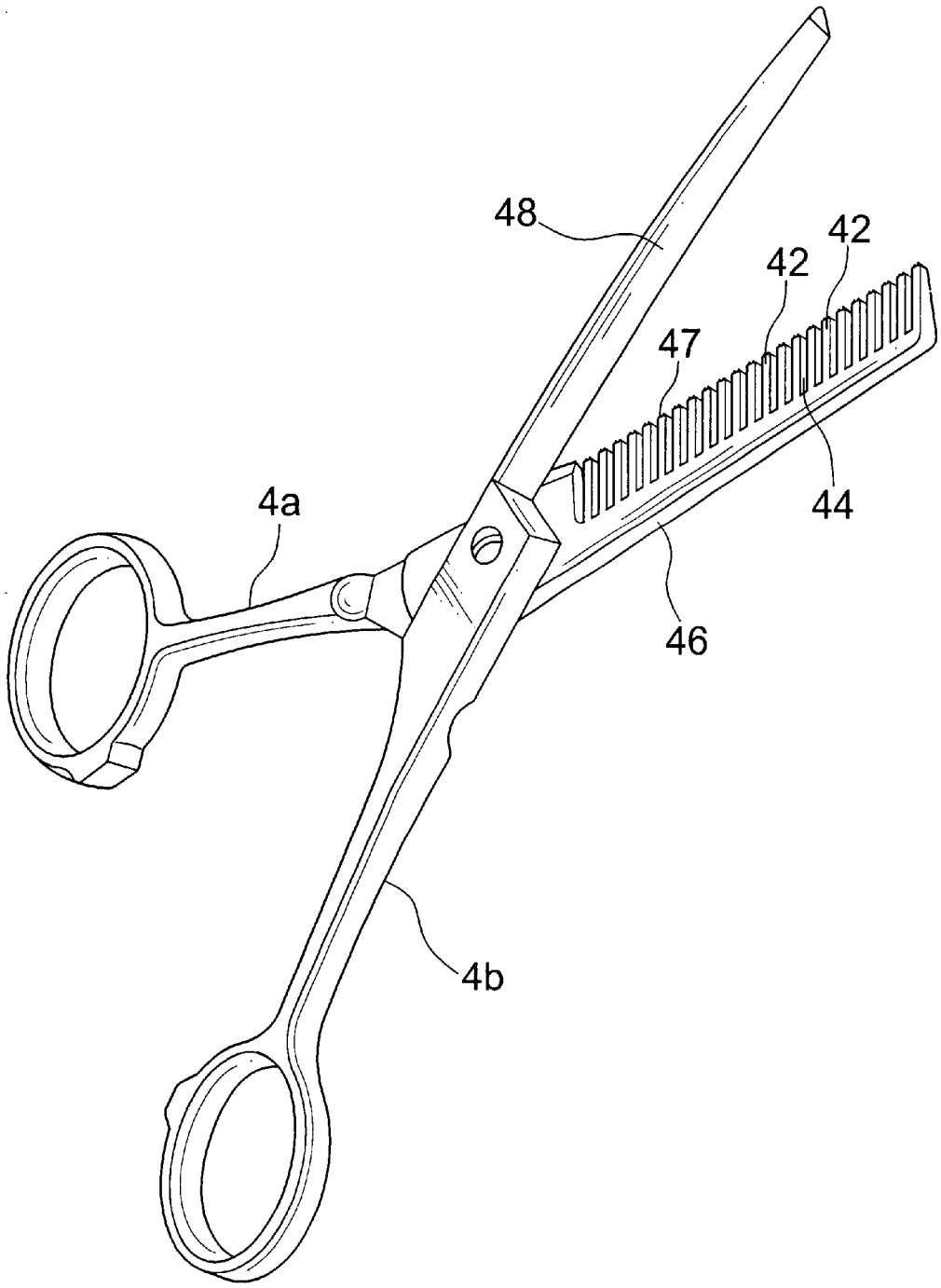
FIG.10 PRIOR ART
FIG. 10 is a perspective view of another pair of conventional hairdressing scissors.
Figure 11:
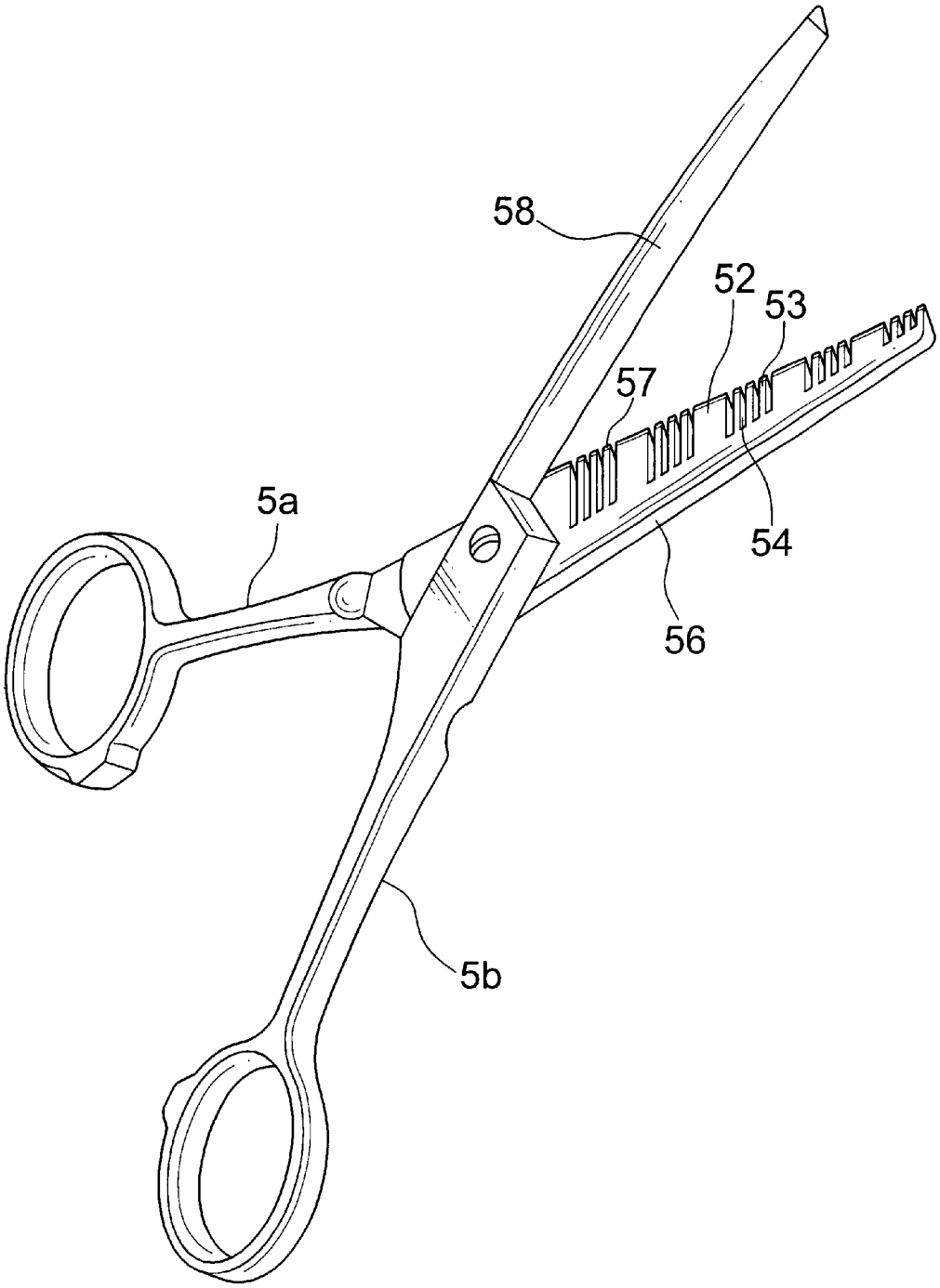
FIG.11 PRIOR ART
FIG. 11 is a perspective view of a further pair of conventional hairdressing scissors.
Figure 12:
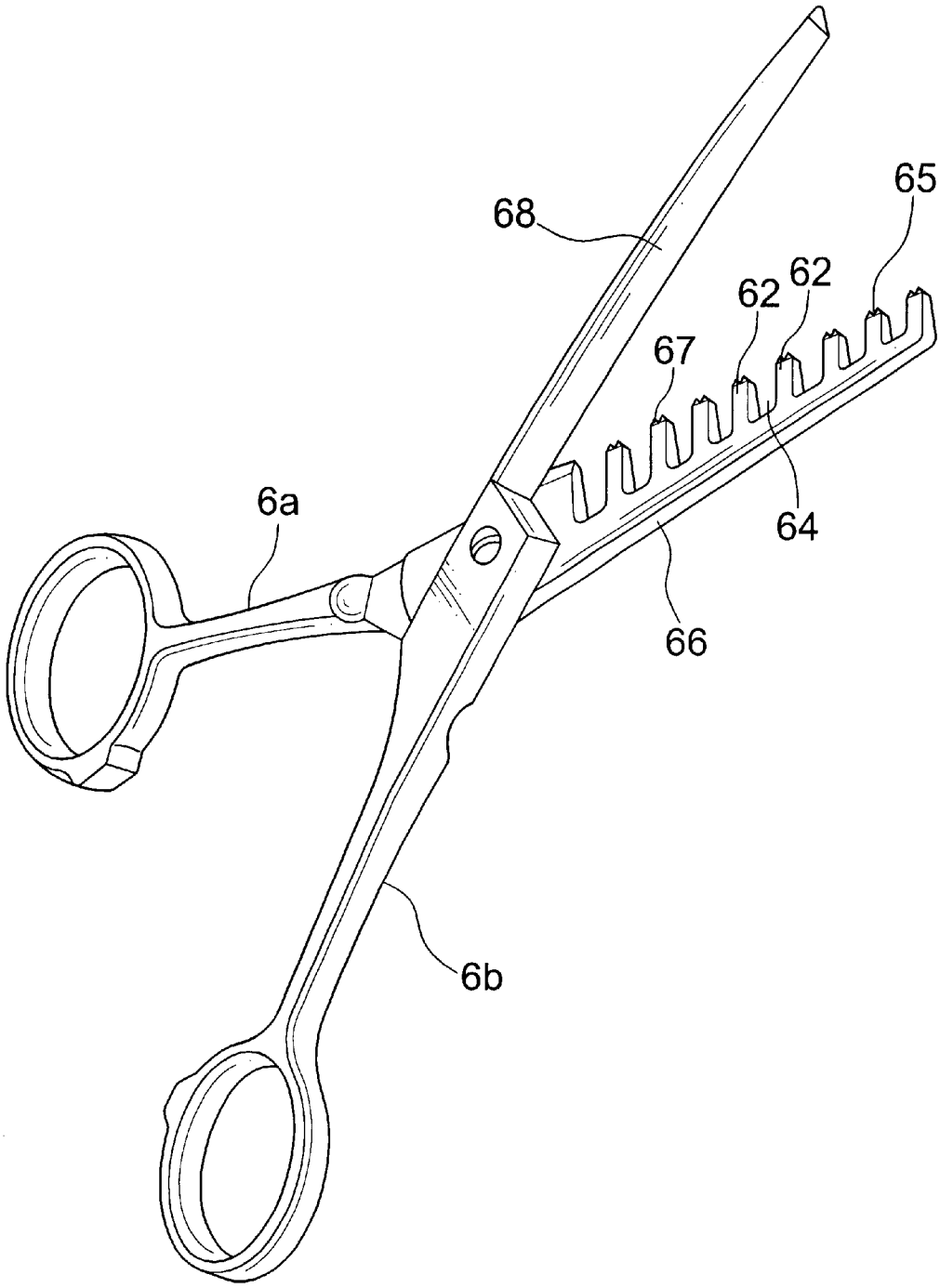
FIG.12 PRIOR ART
FIG. 12 is a perspective view of still another pair of conventional hairdressing scissors.

Referring to FIGS. 1 and 4, a first embodiment of a pair of hairdressing scissors in accordance with the present invention generally includes two scissor elements 1*a* and 1*b* pivotally connected together by a pivot 1*c*. Each scissor element 1*a*, 1*b*, includes a ring portion 1*d* and a blade portion 16, 18, wherein the blade portion 18 has a cutting edge 18*a*. The blade portion 16 of the scissor element 1*a* includes a plurality of narrow teeth 12 that are spaced by an interval 14.

Figure 2:
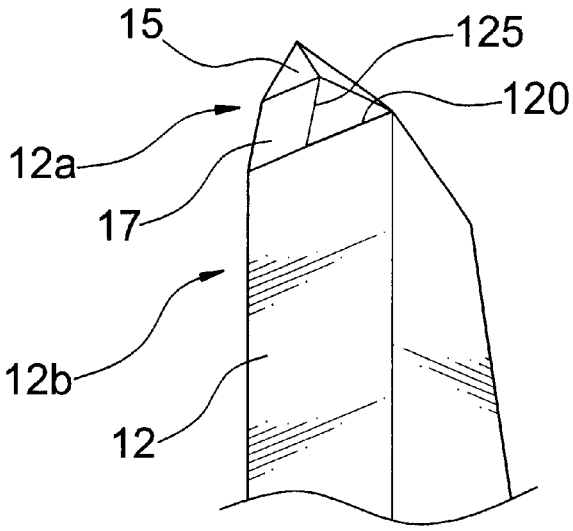
FIG. 2 is a perspective view of an end portion of a tooth of the pair of hairdressing scissors in accordance with the present invention.
Figure 3:
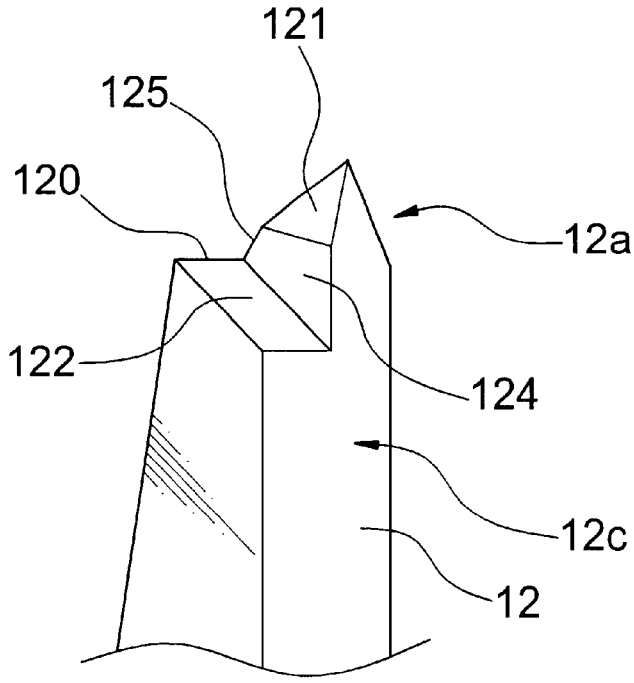
FIG. 3 is a perspective view illustrating the other side of the tooth in FIG. 2.

As illustrated in FIGS. 2 and 3, each tooth 12 on the scissor element 1*a* includes a distal end 12*a* having a first side 12*b* that faces the cutting edge 18*a* of the scissor element 1*b* and a second side 12*c* that faces away from the cutting edge 18*a*. The first side 12*b* of the distal end 12*a* of each tooth 12 is substantially L-shape and includes a distal first guide face 15 and a second guide face 17 extended from the distal first guide face 15. The distal first guide face 15 has a slope smaller than that of the second guide face 17. In addition, the second guide face 17 includes a cutting edge 120 that cooperates with the cutting edge 18*a* of the scissor element 1*b* for cutting hair, best shown in FIG. 2. Referring to FIG. 3, between the first side 12*b* and the second side 12*c* of the distal end 12*a* a distal beveled face 121 is formed for guiding hair to be cut. Between the first side 12*b* and the second side 12*c* and below the distal beveled face 121 are a substantially vertical transition face 124 and then a guide face 122 that meets the first side 12*b* at the cutting edge 120. The transition face 124 and the second guide face 17 meet at an edge 125. The guide face 122 is provided to guide hair that is cut down from the head. It is noted that the beveled face 121 is provided to reduce contact area between the hair to be cut and the operative cutting edge of each tooth 12, thereby achieving the purpose of cutting small amount of hair. In actual use, the pair of scissors in FIG. 1 may cut about 30% of hair that is held between and thus cut by two blade portions 16 and 18. This allows cutting of small amount of hair and creation of special style, e.g., a swollen or high-rise style in which some hair is supported by its surrounding hair.

During hair cutting, upon relative approaching movements between the scissor elements 1*a* and 1*b*, the cutting edge 18*a* of the scissor element 1*b* is firstly in intimate contact with the first guide face 15 of a first tooth 12 (the lowest one in FIG. 4) of the scissor element 1*a* and then the second guide face 17 of the first tooth 12 for performing hair cutting by the cutting edge 120 of the first tooth 12. Next, the cutting edge 18*a* of the scissor element 1*b* is firstly in intimate contact with the first guide face 15 of a second tooth 12 of the scissor element 1*a* and then the second guide face 17 of the second tooth 12 for performing hair cutting by the cutting edge 120 of the second tooth 12. In this way, the cutting edge 18*a* of the scissor element 1*b* cooperates with the teeth 12 on the scissor element 1*a* one by one to cut hair. The two guide faces 15 and 17 on each tooth 12 of the scissor element 1*a* allow easy cutting and smooth engagement between the cutting edge 18*a* of the scissor element 1*b* and the teeth 12 of the scissor element 1*a*. The arrangement of narrow teeth 12 and larger interval 14 is designed for cutting small amount of hair, wherein the two guide faces 15 and 17 are necessary to avoid mutual interference between the scissor elements 1*a* and 1*b* which will occur when the interval between the narrow teeth 12 is larger.

Referring to FIGS. 5 and 6, a second embodiment of a pair of hairdressing scissors in accordance with the present invention generally includes two scissor elements 2*a* and 2*b* pivotally connected together by a pivot 2*c*. Each scissor element 2*a*, 2*b*, includes a ring portion 2*d* and a blade portion 26, 28, wherein the blade portion 28 has a cutting edge 28*a*. The blade portion 26 of the scissor element 2*a* includes a plurality of narrow teeth 22 that are spaced by an interval 14.

As illustrated in FIGS. 7 and 8, each tooth 22 on the scissor element 2*a* includes a distal end 22*a* having a first side 22*b* that faces the cutting edge 28*a* of the scissor element 2*b* and a second side 22*c* that faces away from the cutting edge 28*a*. The first side 22*b* of the distal end 22*a* of each tooth 22 is substantially L-shape and includes a distal first guide face 25 and a second guide face 27 extended from the distal first guide face 25. The distal first guide face 25 has a slope smaller than that of the second guide face 27. In addition, the second guide face 27 includes a cutting edge 220 that cooperates with the cutting edge 28*a* of the scissor element 2*b* for cutting hair, best shown in FIG. 7. Referring to FIG. 8, between the first side 22*b* and the second side 22*c* of the distal end 22*a* a distal beveled face 221 is formed for guiding hair to be cut. It is noted that the distal beveled face 221 includes a truncated tip 221*a* for assisting in hair cutting. Between the first side 22*b* and the second side 22*c* and below the distal beveled face 221 are a substantially vertical transition face 224 and then a guide face 222 that meets the first side 22*b* at the cutting edge 220. The transition face 224 and the second guide face 27 meet at an edge 225. The guide face 222 includes a serrated surface 222*a* for positioning hair to be cut. Namely, the hair to be cut is held in channels 222*b* (FIG. 8A) in the serrated surface 222*a* during cutting. It is noted that the beveled face 221 (except the truncated tip 221*a*) is provided to reduce contact area between the hair to be cut and the operative cutting edge of each tooth 22, thereby achieving the purpose of cutting small amount of hair. In actual use, the pair of scissors in FIG. 5 may cut about 30% of hair that is held between and thus cut by two blade portions 26 and 28. This allows cutting of small amount of hair and creation of special style, e.g., a swollen or high-rise style in which some hair is supported by its surrounding hair.

During hair cutting, upon relative approaching movements between the scissor elements 2*a* and 2*b*, the cutting edge 28*a* of the scissor element 2*b* is firstly in intimate contact with the first guide face 25 (FIG. 5A) of a first tooth 22 (the lowest one in FIG. 5) of the scissor element 2*a* and then the second guide face 27 (FIG. 6A) of the first tooth 22 for performing hair cutting by the truncated tip 221*a* and the cutting edge 220 of the first tooth 22. Next, the cutting edge 28*a* of the scissor element 2*b* is firstly in intimate contact with the first guide face 25 (FIG. 5A) of a second tooth 22 of the scissor element 2*a* and then the second guide face 27 (FIG. 6A) of the second tooth 22 for performing hair cutting by the truncated tip 221*a* and the cutting edge 220 of the second tooth 22. In this way, the cutting edge 28*a* of the scissor element 2*b* cooperates with the teeth 22 on the scissor element 2*a* one by one to cut hair. The two guide faces 25 and 27 on each tooth 22 of the scissor element 2*a* allow easy cutting and smooth engagement between the cutting edge 18*a* of the scissor element 2*b* and the teeth 22 of the scissor element 2*a*. The arrangement of narrow tooth 22 and larger interval 24 is designed for cutting small amount of hair, and the two guide faces 25 and 27 are necessary to avoid mutual interference between the scissor elements 2*a* and 2*b* which will occur when the interval between the narrow teeth 22 is larger.

According to the above description, it is noted that the present invention provides hairdressing scissors that are capable of cutting smaller amount of hair or cutting hair into special style where some of hair is supported by its surrounding hair.

Although the invention has been explained in relation to its preferred embodiment, it is to be understood that many other possible modifications and variations can be made without departing from the scope of the invention as hereinafter claimed.

What is claimed is:

1. A pair of hairdressing scissors comprising first and second scissor elements (1*a* and 1*b*; 2*a* and 2*b*) pivotally connected together, each said scissor element (1*a*, 1*b*; 2*a*; 2*b*) including a blade portion (16, 18; 26, 28), the blade portion (18; 28) of the second scissor element (1*b*; 2*b*) having a cutting edge (18*a*; 28*a*), the blade portion (16; 26) of the first scissor element (1*a*; 2*a*) including a plurality of teeth (12; 22) that are spaced by an interval (14; 24), characterized in that:

each said tooth (12; 22) on the second scissor element (1*a*; 2*a*) includes a distal end (12*a*; 22*a*) having a first side (12*b*; 22*b*) that faces the cutting edge (18*a*; 28*a*) of the first scissor element (1*b*; 2*b*) and a second side (12*c*; 22*c*) that faces away from the cutting edge (18*a*; 28*a*), the first side (12*b*; 22*b*) of the distal end (12*a*; 22*a*) of each said tooth (12; 22) includes a distal first guide face (15; 25) and a second guide face (17; 27) extended from the distal first guide face (15; 25), the distal first guide face (15; 25) has a slope smaller than that of the second guide face (17; 27), the second guide face (17; 27) includes a cutting edge (120; 220) that cooperates with the cutting edge (18*a*; 28*a*) of the second scissor element (1*b*; 2*b*) for cutting hair, and a distal beveled face (121; 221) and a third guide face (122; 222) are formed between the first side (12*b*; 22*b*) and the second side (12*c*; 22*c*) of the distal end (12*a*; 22*a*), the distal beveled face (121; 221) guides hair to be cut, the guide face (122; 222) meets the first side (12*b*; 22*b*) at the cutting edge (120; 220), the third guide face (122; 222) is provided to guide hair that is cut down from the head.

2. The pair of hairdressing scissors as claimed in claim 1, wherein the distal end (22*a*) of each said tooth (22) includes a truncated tip (221*a*) for cutting hair.

3. The pair of hairdressing scissors as claimed in claim 1, wherein the third guide face (222) includes a serrated surface (222*a*) with a plurality of channels (222*b*) for holding the hair to be cut during cutting.

* * * * *

UNITED STATES PATENT AND TRADEMARK OFFICE

CERTIFICATE OF CORRECTION

PATENT NO. : 6,385,851 B2
DATED : May 14, 2002
INVENTOR(S) : Wen-Ya Yeh

It is certified that error appears in the above-identified patent and that said Letters Patent is hereby corrected as shown below:

Title page,
Item [76], cancel "Een-Ya Yeh" and substitute therefor -- Wen-Ya Yeh --.

Signed and Sealed this

Twenty-seventh Day of August, 2002

*Attest:*

*Attesting Officer*

JAMES E. ROGAN
*Director of the United States Patent and Trademark Office*